United States Patent [19]

Stahl

[11] Patent Number: 4,589,866

[45] Date of Patent: May 20, 1986

[54] DECANTER-TYPE CENTRIFUGE

[76] Inventor: Werner Stahl, Stalbuehlweg 8, D-6740 Landau, Fed. Rep. of Germany

[21] Appl. No.: 436,697

[22] Filed: Oct. 26, 1982

[30] Foreign Application Priority Data

Oct. 28, 1981 [DE] Fed. Rep. of Germany ..... 3142805

[51] Int. Cl.[4] ..... B04B 1/20

[52] U.S. Cl. ..... 494/54

[58] Field of Search ..... 494/54, 52, 53, 55; 210/360.1

[56] References Cited

U.S. PATENT DOCUMENTS 3,285,507 11/1966 Shapiro ..... 494/53

FOREIGN PATENT DOCUMENTS 2627265 12/1977 Fed. Rep. of Germany ..... 494/54

*Primary Examiner*—Robert W. Jenkins

*Attorney, Agent, or Firm*—Fleit, Jacobson, Cohn & Price

[57] ABSTRACT

Decanter-type centrifuge separating apparatus, particularly of the countercurrent type, having a transporting screw-type rotor disposed within a rotating barrel to rotate at a differential speed, said machine being characterized by means acting on the liquid flow and/or on previously sedimented solids particles to obtain superior separation efficiencies.

12 Claims, 16 Drawing Figures

Figure 1A:
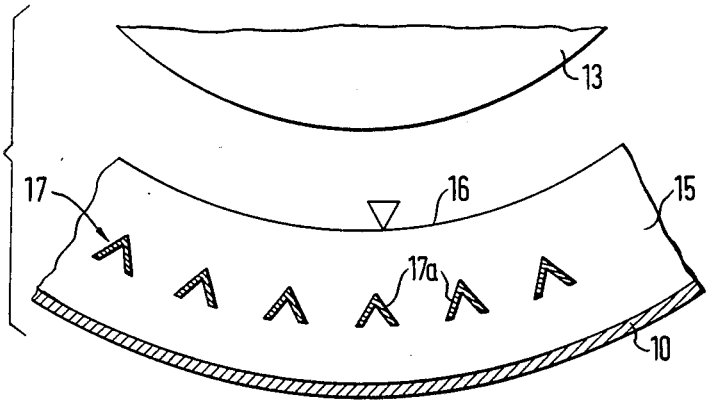
Figure 1B:
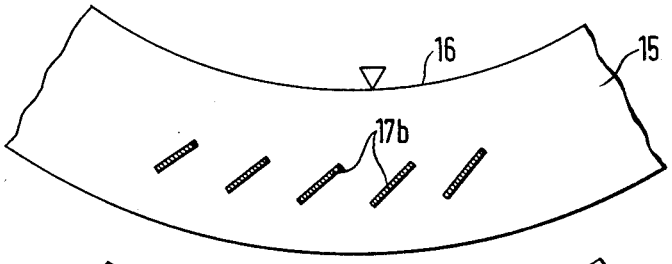
Figure 1C:
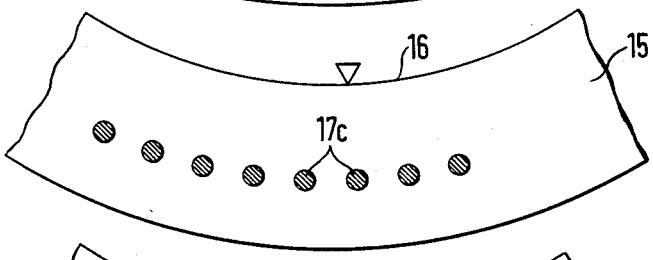
Figure 1D:
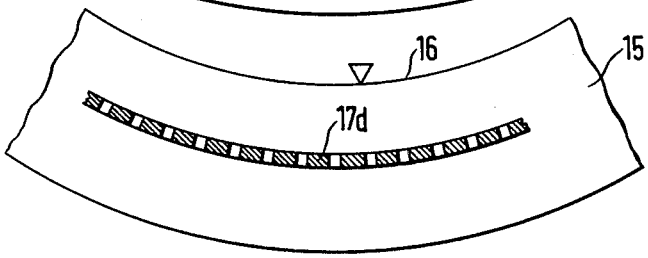
Figure 1E:
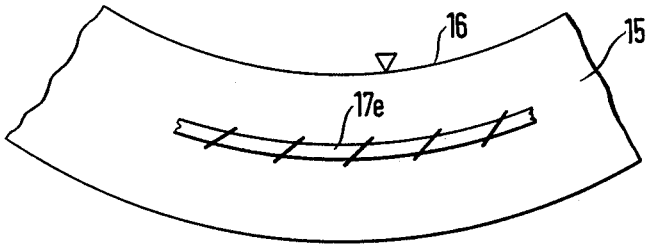

FIG. 2A
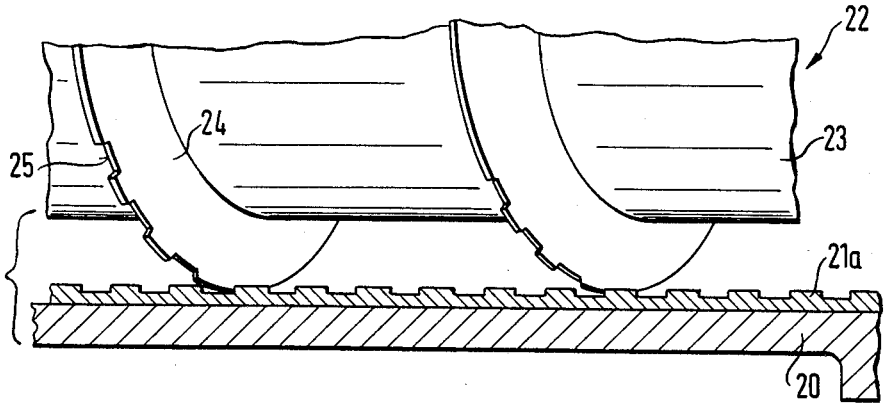
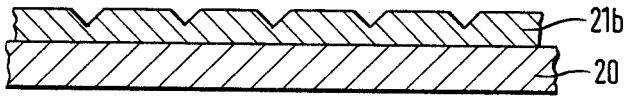
FIG. 2B
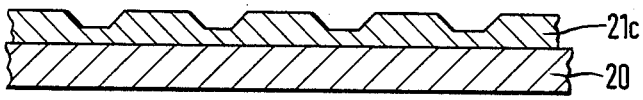
FIG. 2C
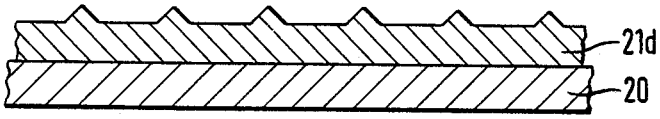
FIG. 2D

DECANTER-TYPE CENTRIFUGE

The invention relates to decanter-type centrifuge separating apparatus, particularly of the countercurrent type, comprising a rotatably mounted fully enclosed barrel and a screw-type rotor rotating therein at a speed differing from the speed of barrel rotation.

Decanter-type centrifuge separators of this kind have been known and may be provided in the form of uniflow or countercurrent machines. Predominently, these machines are countercurrent designs, which will be referred to briefly as "countercurrent decanters" hereinafter. Also, the term "decanter" will be used below instead of "decanter-type centrifuge separators".

As to basic operation, a decanter may be thought of as a sedimentation or settling basin rolled upon itself to form a fully enclosed shell or jacket, with the separation efficiency increasing as centrifugal force exceeds gravitational acceleration.

This is the thought underlying Stoke's method of calculating the solids settling rate.

It has been known, however, that this model is not generally applicable; in many cases the solids content in the centrate will increase abruptly once a critical value has been exceeded, whereas on the basis of Stoke's method the solids content should increase monotonously.

Even though there does not exist to this date a satisfactory explanation for the aforesaid abrupt increase of the solids content in the centrate, designers have drawn practical consequences from the observed phenomenon. One of these results is the uniflow decanter; however, as is well known a machine of this kind has to be operated at relatively high liquid levels, It has been possible to obtain fairly good results from uniflow decanters in the case of specialized separation samples; in particular, it has been possible to obtain a monotonous increase of the solids content and to avoid any abrupt increase thereof.

To improve separation, an attempt was made (DE-OS No. 19 52 942) in a machine known to those in the art as "Krüger decanter" to avoid detrimental influences of flow disturbances in the screw by causing the inner one of the two screws to withdraw the entrained solids from the centrate ahead of the overflow and to transport them into the space of the outer screw, the sole remaining task of the outer screw being to transport the solids, which are thickened further along the way by the removal of moisture.

The Krüger decanter is most complicated in structure, however, and very expensive to manufacture; also, its throughput relative to machine size is unsatisfactory.

In addition, the uniflow decanter has fundamental shortcomings. The solids must be transported along the entire length of the cylindrical barrel section, resulting in high machine torques. Also, a relatively large planetary transmission must be used. The drive shaft for the rotor must be large in size, and the rotor and its screw are subject to substantial wear along their entire length, as is the barrel.

Furthermore, separation and—above all—the transport of paste-like sediments by the rotor may cause solids to accumulate backwardly from the tapered barrel section far into the cylindrical section. A solids wedge built up this way may reach substantial thickness near the transition between the cylindrical and tapered barrel sections. It is in that region, however, that the discharge opening is located for the separated liquid. As a result, in a uniflow decanter, solids may be entrained into the discharged liquid.

Also, for improving separation, it has been known by German Pat. No. 1,482,714 to combine a disc-type separator with decanter-type structure. Although a combination of this type promises superior separation performance, it has never been put to practice to any extent because of its complicated construction.

It is the object underlying the invention to provide decanter-type centrifuge separating apparatus of the kind specified hereinabove which enables unusually good separation to be obtained by acting on the flow in a region along the inner barrel surface while maintaining good moisture removal and solids transport performance.

For achieving this object in accordance with the invention, there is provided between the flights of the screw at pre-determinable distances from the inner barrel surface structure forming flow obstacles which substantially reduce the velocity of liquid flow in the area between such structure and the barrel, with the distance between the radially outer extremities of such structure and the inner barrel surfaces being such that the sediment the flights of the screw compact into a solids cake may advance unhindered.

The insight underlying the invention is that there occurs—in addition to the predictions of Stoke's theory—an effect determined largely by drag forces acting on solids particles deposited previously in the area of the solids base layer or the inner barrel surfaces. After the inventor herein had realized that these drag forces contribute decisively to an abrupt increase of the solids content in the centrate, it was possible—on the basis of the thought underlying the invention—to avoid such abrupt increase of the solids content in the centrate and to obtain outstanding separation performance by providing measures to calm or decelerate the flow adjacent the base layer or the inner barrel surfaces and thus to control the detrimental drag forces. Basically, the invention provides a substantial reduction of the flow velocity adjacent the base layer or the inner barrel surfaces so that the undesirable abrupt increase of the solids content in the centrate will be avoided and separation performance be improved considerably.

Preferrably, the aforesaid structure should be provided at about the middle of the liquid level, with particular preference given to an embodiment of the subject matter of the invention in which the structure is provided right below the middle of the liquid level.

Such arrangement has the advantage that flow velocity will be reduced considerably between the structure and the barrel while the clearance remaining below the structure will be sufficient for the passage therethrough of the solids cake.

Depending on the product to be treated, provisions may be made either to keep constant the distance between the structure and the barrel along the barrel length or to cause the distance between the structure and the barrel to decrease along the barrel length. This way, the expectable distribution of the solids along the barrel length may be accommodated.

In particularly preferred embodiments of the inventive decanter-type centrifuge separating apparatus, the aforesaid structure may be in the form of substantially parallel ridge elements, flat strip elements, circular pins or studs, perforated sheet material and/or expanded sheet metal material. The shape of and the spacing between the individual elements of such structure should be selected so that sedimenting particles may slide off the relatively steep surfaces of such elements, enter the protected area underneath the elements and be deposited permanently therein. This way, separation performance will improve substantially.

Also, in accordance with the invention, the elements may preferrably be disposed in parallel with the barrel axis or normal to the surface of the flights of the screw. This type of configuration will result in an arrangement which is relatively simple in construction.

According to an alternative embodiment of the subject matter of the invention, the flights of the screw are notched along their radially outer edges. Preferrably, such notches are square, groove-like, V-shaped, saw-tooth-shaped or similar in geometry, the important feature being that "traps" will form in the solids base layer in directions perpendicular or at an angle to the direction of flow to trap the solids particles. Traps of this type allow for a realization of the thought underlying the invention by apparatus features, i.e. to substantially decrease the flow velocity near the base layer or the inner barrel surfaces.

According to another alternative embodiment of the inventive decanter-type centrifuge separating apparatus, permanent residence of solids particles may be produced by reducing the diameter of the screw along the barrel in steps of pre-determinable lengths. Preferrably, the diameter of the inner surface of the barrel is reduced in steps as well, with the gap remaining between the screw and the barrel having a width substantially constant along the barrel. In this embodiment of the subject matter of the invention, solids particles having reached the base layer but entrained along the barrel by the substantial drag extant will be transported in front of the individual steps into areas in which the flow has been calmed largely so that they will settle permanently in this area because they will not be able to ascend to the next step ahead.

In order to overcome detrimental drag forces, or to increase the sedimentation forces acting on the solids particles, another alternative embodiment of the subject invention has a solids adhering layer provided on the inner barrel surfaces. Preferrably, this adhering layer may be in the form of a rough inner surface of the barrel. However, the inner barrel surface may be provided also with grooves, knubs, barbs or the like. Essentially, the desired effect will be obtained also by providing on the inner barrel surfaces a coating having a high coefficient of friction.

In many cases, and if the solids have corresponding properties, the adhering layer may have magnetic properties. This way of realizing by apparatus features the thought underlying the invention has advantages in that an existing machine may be re-fitted in accordance with the invention so that its separation efficiency will improve considerably.

Within the ambit of the invention, it is possible for example to provide in the barrel of a decanter-type centrifuge separator, prior to putting it into operation, a base layer comprising a suitable foreign material such as a heavy ore, a tar-like material or a substance generally in the form of a non-Newtonian fluid. By providing suitable materials inside the barrel it is possible to form a base layer of which the geometry and/or adhesive properties greatly promote the separation process.

The invention is highly advantageous also because it is suited for reequipping existing machines.

In order that the invention, its features and its attendant advantages may be fully understood, exemplary embodiments thereof will now be described under reference to the drawing.

Figure 1F:
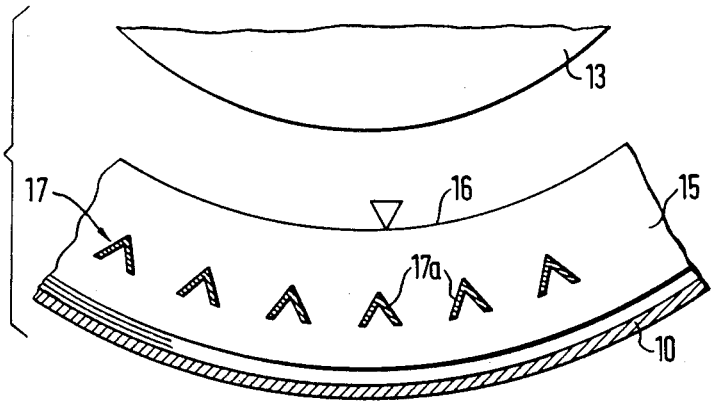
Figure 1G:
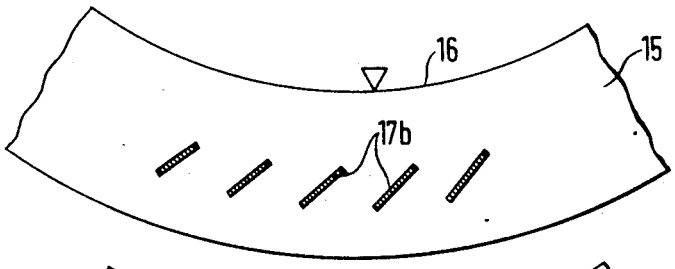
Figure 1H:
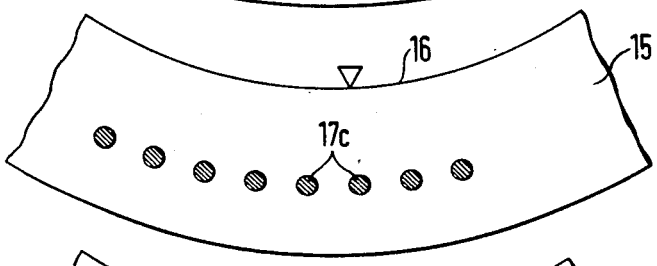
Figure 1I:
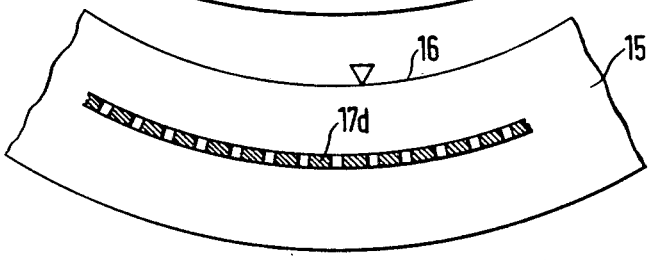
Figure 1J:
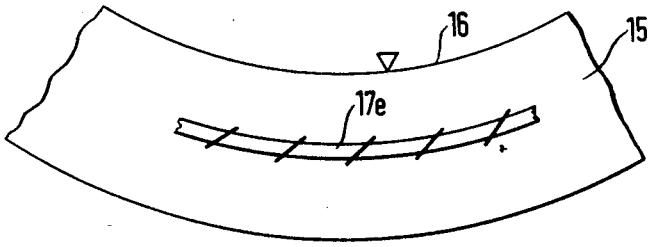
Figure 3A:
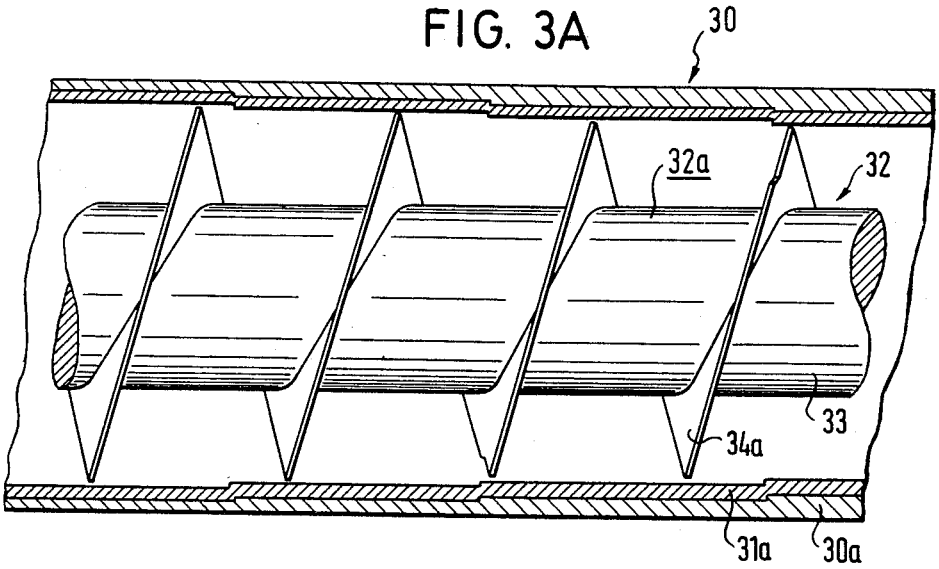

FIGS. 1A through E shows a number of partial cross sections through a portion of a transporting screw and represent in a purely schematic manner structure for calming the flow therethrough;

FIGS. 1F through J show a number of partial cross sections through a portion of a transporting screw and represent in a purely schematic manner structure for calming the flow therethrough, the distance between the structure and the barrel decreasing along the length of the barrel, FIG. 1F illustrating a view of the barrel tapering inwardly from the exposed outer edge;

FIGS. 2A through D show a schematic perspective view of a flight having notches along its outer edge and the surface structure said notches generate in the solids cake;

FIGS. 3A and B show a schematic longitudinal section through an inventive decanter-type centrifuge separator with the diameter of the transporting screw reduced in steps along the barrel.

FIG. 1 is divided into FIGS. 1A to 1E. A barrel 10 encloses a screw-type rotor of which body 10 is shown in partial cross section. Both the barrel and the rotor turn about a common axis, but at different speeds. As shown in FIG. 1, centrifugal force holds a liquid 15 on the inner surface of barrel 10 to a level 16. The solids particles, of which the specific gravity is higher than the liquid's, tend to deposit on the inner surface of barrel 10. As adjacent flights of the screw—as shown in FIG. 2A, for example—define between them a liquid flow channel in which the flowing liquid 15 has substantial velocity, the solids particles are subject to forces sufficiently high to prevent sedimented particles from staying in position and to flush them away. Structure provided in accordance with the invention and shown generally at 17 in FIG. 1 substantially prevents the aforesaid flushing effect by greatly calming the flow between elements 17 and barrel 10. FIGS. 1A to 1E show between the flights of the screw (not shown) various configurations of the proposed structure, namely, ridge elements 17*a*, strip elements 17*b*, circular pins or studs 17*c*, perforated sheet 17*d* and expanded sheet metal lath 17*e*. These elements are disposed somewhat below the middle of liquid level 16 and are spaced from barrel 10 a distance so that the solids cake to be transported may pass through under them. The shape of and the spacing between the elements are selected so that depositing particles will slide off relatively steeply sloped surfaces of the elements and enter the protected area below the elements.

FIG. 2 shows generally at 22 in its entirety a screw-type rotor within a barrel 20, comprising on rotor body 23 a flight 24 having notches 25 in the area of the outer edge. Notches 25, which FIG. 2A shows as being square in section, generate in base layer 21*a* a complementary configuration.

FIGS. 2B to 2D show alternative configurations of base layers 21*b*, 21*c* and 21*d*, respectively, which result from correspondingly shaped notches in the edges of the flight. Depending on the sectional shape of the flights used in a specific case, there may form in base layer 21 in barrel 20 grooves or the like which act as "traps" for the solid particles.

In accordance with the invention, the distance between the outer edge of the screw and the inner barrel surface may be selected intentionally to be relatively great in order to allow a relatively thick base layer to form which will accommodate traps having for trapping solids particles a suitable surface configuration and, particularly, a sufficient depth.

FIG. 3 shows a screw-type rotor 32 in a barrel 30, with the diameter of the rotor decreasing in steps along the barrel.

As shown in FIG. 3A, there is provided in a barrel 30 a screw-type rotor 32*a* comprising on a rotor body 33 a screw 34 of which the radial extent decreases in steps along the barrel 30*a*, as does the diameter of barrel 30*a*, so that a base layer 31*a* will form of which the thickness is substantially constant along the longitudinal extent of barrel 30*a*.

Figure 3B:
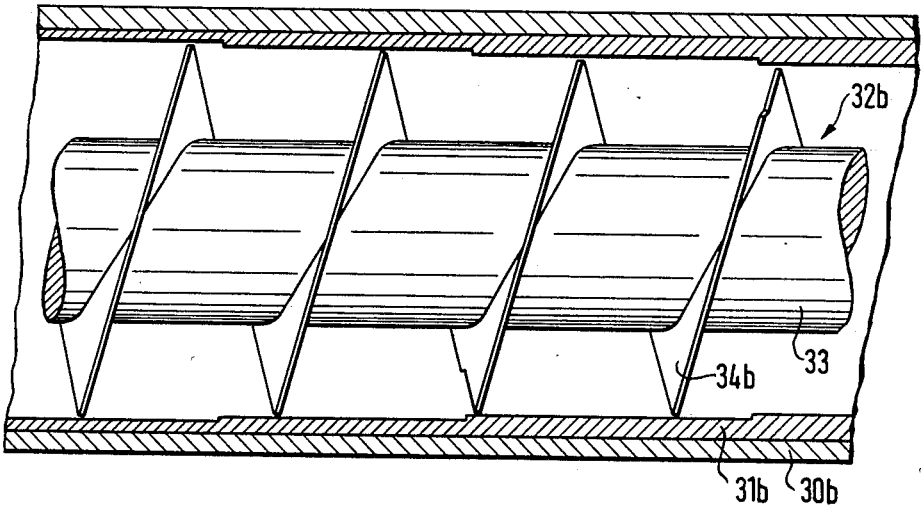

The arrangement according to FIG. 3B differs from the corresponding one in FIG. 3A, essentially, in that barrel 30*b* has an internal diameter which is substantially constant along the longitudinal extent of barrel 30*b*. As the diameter of a screw 34*b* on rotor 32*b* decreases progressively in steps, a base layer 31*b* will form between screw 33 and barrel 30*b* of which the thickness increases in steps along barrel 30*b* in the direction of centrate flow. In other words: The thickness of base layer 31*b* increases in a stepwise fashion in the direction of liquid flow.

While the drawing and the corresponding description hereinabove show and explain preferred embodiments only of the subject matter of the application it is clear that analogous and/or similar measures are within the scope of the invention as long as they provide for decelerated or, in general, calmed flow adjacent the inner barrel surfaces in a manner such that sedimentation will be promoted and previously deposited particles will remain in place.

I claim:

1. Decanter-type centrifuge separating apparatus, particularly of the countercurrent type, said apparatus comprising a rotatably mounted fully enclosed barrel, a transporting screw-type rotor rotating at a speed differing from the speed of barrel rotation, a structure extending parallel to the longitudinal axis of the barrel and mounted between the flights of the transporting screw to rotate with the transporting screw at a pre-determinable distance from the inner surface of the barrel to form flow obstacles greatly reducing the velocity of liquid flow in the area between said structure and the barrel, with the distance between the radially outer extremities of said structure and the inner surface of the barrel being such that transport of the sediment the flights compact into a solids cake remains unhindered.

2. Apparatus as in claim 1, characterized by said structure being disposed in the area of the middle of the liquid level.

3. Apparatus as in claim 2, characterized by said structure being disposed just below the middle of the liquid level.

4. Apparatus as in claim 1, characterized by the distance between said structure and the barrel being constant along the length of the barrel.

5. Apparatus as in claim 1, characterized by the distance between the structure and the barrel decreasing along the length of the barrel.

6. Apparatus as in claim 1, characterized by said structure comprising ridge elements extending substantially in parallel.

7. Apparatus as in claim 1 characterized by said structure comprising strip material elements extending angularly and substantially in parallel with each other.

8. Apparatus as in claim 1, characterized by said structure comprising circular pins or studs extending substantially in parallel.

9. Apparatus as in any one of claims 1 to 5, characterized by said structure comprising a perforated sheet metal member.

10. Apparatus as in any one of claims 1 to 5, characterized by said structure comprising expanded sheet metal lath.

11. Apparatus as in claim 1 characterized by said elements being disposed normal to the surface of the flights of the screw.

12. A decanter-type centrifuge separating apparatus, particularly of the countercurrent type, including a rotatably mounted fully enclosed barrel and a transporting screw-type rotor rotating at a speed differing from the speed of barrel rotation, characterized by means for producing a plurality of zones located adjacent to the inner barrel surface through which the flow velocity of the liquid is decelerated to reduce the drag forces being exerted on particles that have been deposited on the inner barrel surface and to prevent an increase in the particles in the centrate of the liquid that have been deposited on the inner barrel surface.

* * * * *